US007941881B2

(12) United States Patent
Hayes et al.

(10) Patent No.: US 7,941,881 B2
(45) Date of Patent: May 17, 2011

(54) BED CONTROL PROCEDURE

(75) Inventors: Stephen Hayes, Dudley (GB); Stephen Hollyoak, Kingswinsford (GB)

(73) Assignee: Huntleigh Technology Limited (GB)

( * ) Notice: Subject to any disclaimer, the term of this patent is extended or adjusted under 35 U.S.C. 154(b) by 275 days.

(21) Appl. No.: 12/092,854

(22) PCT Filed: Nov. 7, 2006

(86) PCT No.: PCT/GB2006/004145

§ 371 (c)(1),
(2), (4) Date: May 7, 2008

(87) PCT Pub. No.: WO2007/054677

PCT Pub. Date: May 18, 2007

(65) Prior Publication Data

US 2008/0276369 A1 Nov. 13, 2008

(30) Foreign Application Priority Data

Nov. 14, 2005 (GB) ..... 0523171.7

(51) Int. Cl.
*A61G 7/012* (2006.01)

(52) U.S. Cl. ..... 5/611; 5/600; 5/11

(58) Field of Classification Search ..... 5/611, 11, 5/600, 616

See application file for complete search history.

(56) References Cited

U.S. PATENT DOCUMENTS

| | | | | |
|---|---|---|---|---|
| 3,972,081 | A * | 8/1976 | Stern et al. | 5/618 |
| 4,062,075 | A | 12/1977 | Stern et al. | |
| 5,903,940 | A | 5/1999 | Völker et al. | |
| 6,000,077 | A | 12/1999 | Cyr | |
| 6,161,236 | A * | 12/2000 | Carroll | 5/618 |
| 6,351,678 | B1 | 2/2002 | Borders | |
| 6,601,251 | B2 * | 8/2003 | Paul | 5/611 |
| 2001/0047547 | A1 * | 12/2001 | Paul | 5/611 |
| 2008/0086815 | A1 * | 4/2008 | Kappeler et al. | 5/600 |
| 2008/0141459 | A1 * | 6/2008 | Hamberg et al. | 5/600 |
| 2008/0276369 | A1 * | 11/2008 | Hayes et al. | 5/11 |

FOREIGN PATENT DOCUMENTS

DE 94 04 382 U1 5/1994

* cited by examiner

*Primary Examiner* — Robert G Santos
(74) *Attorney, Agent, or Firm* — Craig A. Fieschko, Esq.; DeWitt Ross & Stevens S.C.

(57) ABSTRACT

A bed assembly includes a wheeled base, a sub-frame and mattress support frame. The sub-frame supports a plurality of electrically operated actuators which provide for raising and lowering of the bed. The bed can be lowered to a first low position in which the bed frame is around 38 to 45 centimeters above floor height and to a lower position in which the frame is around 30 centimeters above floor height. The bed is lowered to the first height upon receipt of a first command input and can only be lowered below that first height upon receipt of a second control input distinct from the first control input. Preferably, the bed is lowered at a slower speed from the first low height to its lowermost position.

24 Claims, 2 Drawing Sheets

BED CONTROL PROCEDURE

FIELD OF THE INVENTION

The present invention relates to a bed assembly and in particular to a method of controlling the height of the bed.

BACKGROUND OF THE INVENTION

Typical modern hospital beds are adjustable into a plurality of different configurations and different heights. In order to achieve adjustment of the bed, there is provided a plurality of electrically operated actuators. For the purposes of patient comfort, the patient is able to adjust the configuration of the bed and also its height. For example, for many care procedures, including moving the patient onto and off the bed, the bed may need to be configured into a lying position and may need to be set at a particular height which is not comfortable for the patient. During resting and convalescence periods, however, the patient may wish to configure the bed into more of a sitting position and may wish to adjust the height of the bed, for example to improve interaction with visitors and other patients.

It is also desirable to be able to lower a hospital bed to an extra low height, for example to be only 30 centimeters or so above floor height. This may be advantageous, for example, to assist a patient in getting onto or getting off the bed. An example of structure which allows for such an extra low bed height is disclosed in the applicant's co-pending British patent application number GB 0523180.8.

However, such an extra low height is below the height required for some care procedures. For example, most patient hoists operate from a height of around 40 centimeters above floor level. Similarly, some wheeled stretchers do not drop to less than 40 centimeters or so. Therefore, having a bed which can be lowered below the height for such devices can be problematic in forcing care staff to control the bed height, often visually, until the desired height is achieved. This is not an ideal solution in many instances.

SUMMARY OF THE INVENTION

The present invention seeks to provide a bed control procedure which can avoid such disadvantages.

According to an aspect of the present invention, there is provided a method of controlling the height of a bed provided with one or more height control actuators, including the steps of providing a first control input which lowers the bed to a first height and a second control input distinct from the first control input for lowering the bed lower than said first height.

Advantageously, the method includes the step of stopping lowering of the bed when the first height is reached.

Preferably, the first height is an operating height, such as around 38 to 45 centimeters from floor level, which allows staff to carry out care operations on the patient, such as coupling the patient to a hoist, moving the patient onto and off the bed and so on. The bed can be lowered, however, to an extra low height, in the preferred embodiment to around 30 centimeters from the floor. This extra low height can be useful in assisting a patient getting onto the bed and getting off the bed as it allows the patient to sit on the bed with his/her feet touching the ground.

In the preferred embodiment, the first control input is effected by a single command on a key pad and the second control input is effected by a complex control input. Advantageously, the second control input requires a double input from an operator, such as pushing two or more buttons on a key pad, by pressing a button a plurality of times or by a command sequence. The lowering of the height of the bed to its extra low height should be effected only intentionally and when there is suitable control. The reason for this is that the bed should not be lowered beyond its operating height in medical emergencies, for example if the patient must be moved from the bed quickly. Secondly, it is not uncommon for medical equipment or other items to be located under the bed frame and thus lowering the bed beyond the normal low height of 38 to 45 centimeters could interfere with such equipment or devices. For this reason, it is also preferred that the rate of lowering of the bed is reduced from the normal low height to the extra low height. Thus, the care personnel can monitor what is happening around and below the bed while it moves from its normal low height to its extra low height.

Advantageously, the second control input is provided on a key pad used by hospital staff. Typically, beds are provided with key pads used by the patient and key pads used by nursing and other medical staff. In light of the above-mentioned considerations, and in particular since a patient is unlikely to be able to see what lies underneath the bed, it is preferred that the patient is not able to lower the bed beyond the normal low height.

According to another aspect of the present invention, there is provided a system for adjusting the height of a hospital bed provided with one or more height control actuators, including an input unit arranged to provide a first control input, a control unit operable upon receipt of the first control input to lower the bed to a first height, the input unit being arranged to provide a second control input distinct from the first control input, the control unit being operable upon receipt of the second control input to lower the bed lower than said first height.

According to another aspect of the present invention, there is provided a bed assembly including a height adjustment system as specified herein.

BRIEF DESCRIPTION OF THE DRAWINGS

Embodiments of the present invention are described below, by way of example only, with reference to the accompanying drawings, in which.

DETAILED DESCRIPTION OF PREFERRED EMBODIMENTS OF THE INVENTION

Figure 1:
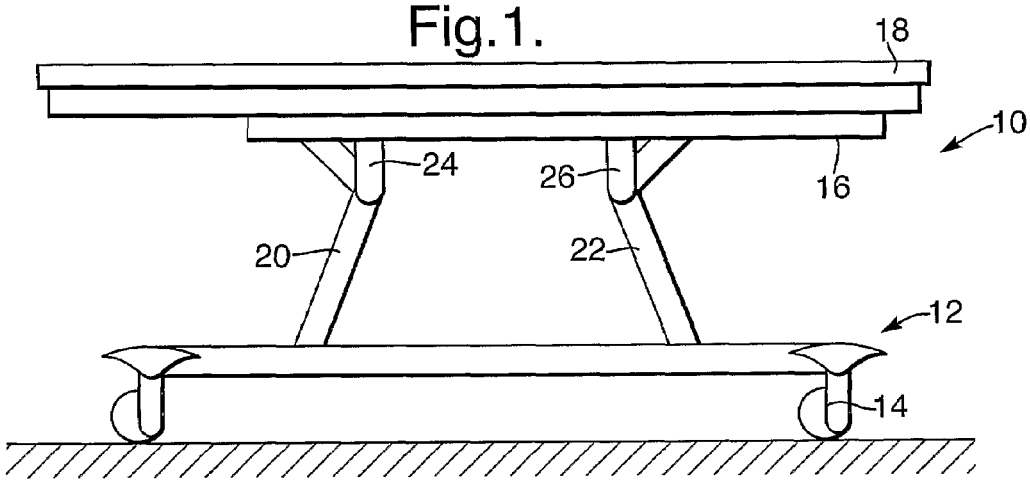
FIG. 1 is a side elevational view of a part of a bed assembly in a raised position.

Referring to FIG. 1, there is shown an embodiment of bed assembly 10 which includes a wheeled base 12 provided with four castors 14, a sub-frame 16 and mattress support frame 18. The sub-frame 16 supports a plurality of electrically operated actuators (not shown in FIG. 1) which provide for raising and lowering of the bed 10 and for raising and lowering of the configurable sections of the mattress support frame 18. The sub-frame and the mattress support frame 18 can be of a type known in the art or of a type disclosed in the applicant's co-pending British applications filed on the same date as the present application.

The assembly 10 includes, in this example, first and second pivotable struts 20, 22 which have a first end pivotably coupled to depending support flanges 24, 26 of the sub-frame 16 and a second end which is slidably received in a suitable guide (not shown) in the wheeled base frame 12. An electrically controlled actuator (not shown in FIGS. 1 to 3) can be controlled to change the angle of pivot of the struts 20 and 22, thereby to adjust the height of the bed, that is of the bed frame 18. This arrangement is as shown in co-pending British patent application number GB 0523180.8, although the bed 10 may be provided with any other known height adjustment mechanism which can provide the desired height adjustment.

Figure 2:
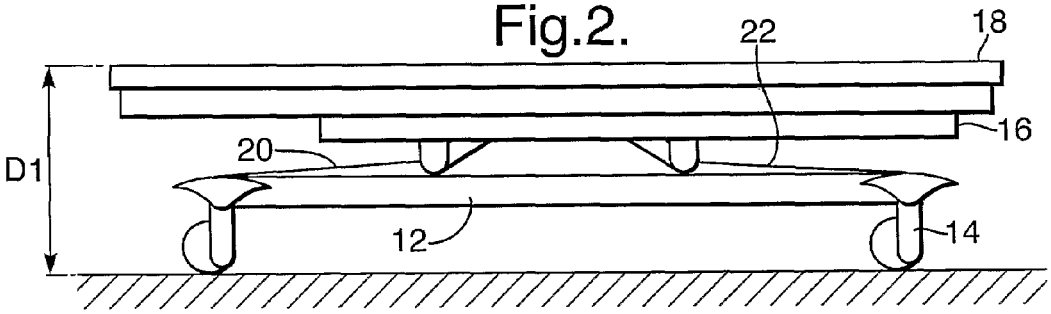
FIG. 2 is a side elevational view similar to FIG. 1, showing the bed assembly in its first low position.

FIG. 1 shows the bed 10 in a raised position, in which the bed frame 18 and hence the mattress (not shown) and patient are at a reasonable height above ground level. FIG. 2, on the other hand, shows the bed 10, that is the bed frame 18, in what is termed herein the first low level, typically a care operating level. At this level, which preferably corresponds to a standard minimum height provided by most hospital beds, a patient can be lifted by a hoist and transferred to wheeled stretchers and the like. This height (denoted by $D_1$ in FIG. 2) is typically 38 to 45 centimeters from floor level. As it is not uncommon to place equipment below the bed, such as fluid collection vessels, at this height $D_1$ such equipment can typically remain under the bed without being squashed thereby.

Figure 3:
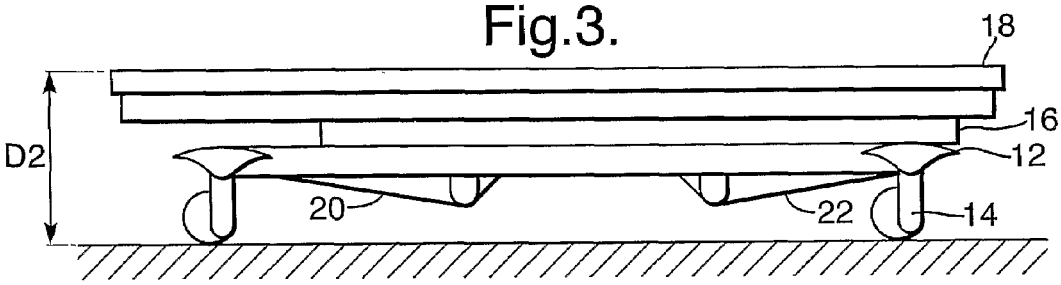
FIG. 3 is a side elevational view similar to FIG. 1 showing the bed in its lowermost position.

The bed 10 can be dropped to less than height $D_1$, as shown in FIG. 3. At this height, the sub-frame 16, in this embodiment, rests on the base frame 12, while the struts 20, 22 and depending flanges 24, 26 pass within the base frame 12, as will be apparent from FIG. 3. The height $D_2$ reached in FIG. 3 is preferably less than 35 centimeters and most preferably around 03 centimeters. At this height it is most comfortable for a patient to get onto and get off the bed 10. However, at this height, there is little space below the bed frames 16, 18 to accommodate any equipment or any other items and it is therefore desirable to be able to ensure that no such equipment is squashed by the frames 16, 18 when the bed is lowered from the first low position shown in FIG. 2 to the lowest low position shown in FIG. 3.

Figure 4:
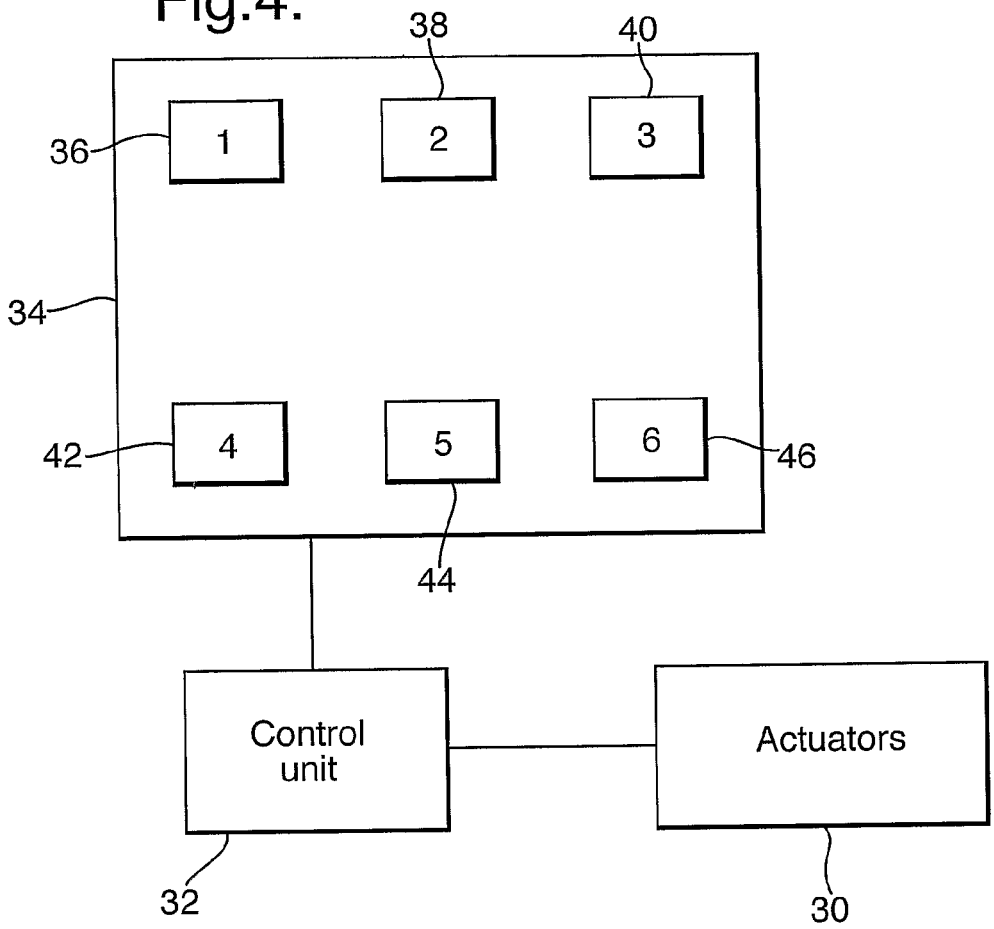
FIG. 4 is a schematic view of an embodiment of height adjustment control system.

FIG. 4 shows in schematic form an embodiment of control assembly for controlling the height adjustment of the bed 10, that is of the bed frame 18. The system includes a plurality of actuators 30, which are the actuators provided in the bed 10 for adjusting the various bed sections as described above. A control unit 32 controls the operation of the actuators and can be of a type generally found in existing electrically controlled hospital beds. A key pad 34 is coupled to the control unit and can be used to provide desired adjustments to the bed, such as height adjustments, configuration adjustments of the various bed sections to reconfigure the bed into a seat, into a legs up configuration and so on. For this purpose, the key pad 34 is provided with a plurality of keys or buttons 36-46. As the types of functions performed by the keys and the selectable adjustments provided by the keys are of a type known in the art, FIG. 3 does not indicate the specific keys provided nor the entire set of keys which may be provided. These will be well known to the person skilled in the art given the common use of such key pads 34.

In this embodiment, one of the keys 36-46 is a bed height reduction key, which operates the actuator 30 which is coupled to the struts 20, 22. Thus, when depressed, this key cause the actuator 30 to lower the height of the bed towards its minimum height. In this embodiment, however, the height reduction key can only effect a reduction to the first low height shown in FIG. 2, that is to a height of around 38 to 45 centimeters. Any reduction in height below this first low height cannot be achieved with simple depression of that key.

In order to effect the final lowering in height of the frame 18, the control unit 32 must be provided with a complex input from the key pad 34. In the preferred embodiment, it is necessary to depress two of the keys 36-46 simultaneously in order to effect a lowering of the bed from the height $D_1$. In another embodiment, the control unit 32 requires a complex input sequence, for example a double depression of one of the keys 36-46 within a given time period. Basically, any complex input could be used, the preferred, as said being the simultaneous depression of two keys 36-46 as this minimises the unlikely activation of this function without unduly complicating the control input.

In the preferred embodiment, the input required to effect the extra low height reduction process is only accepted by the control unit 32 when the bed is sensed to be in the first low position $D_1$. For this purpose, as is conventional with such beds, there is provided a series of position sensors.

As the bed frames 16, 18 move to be very close to the floor, the movement of the bed from the first low height position shown in FIG. 2 to the extra low height position shown in FIG. 3 is effected at a slower speed than the height reduction to the first low height position shown in FIG. 2. Preferably, the control unit 32 controls the actuators 30 to move at half speed.

Figure 5:
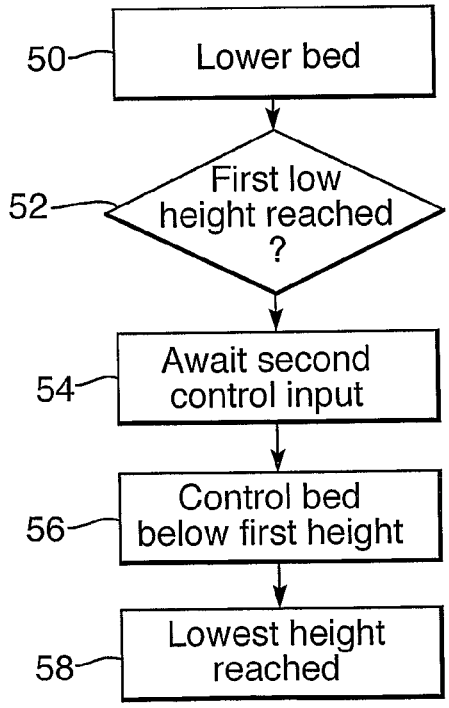
FIG. 5 is a flow chart showing the principal steps in of the preferred adjustment method.

An embodiment of control routine performed by the control unit 32 is shown in FIG. 5. At step 50, upon receipt of the appropriate input on key pad 34, the control unit 32 lowers the bed by controlling the appropriate actuator or actuators 30. At step 52 the control unit 32 determines when the bed 10 has reached the first height position shown in FIG. 2 and when this has been deemed to have been reached the control unit 32 stops operation of the appropriate actuator or actuators so as to keep the bed 10 in its first low height position. The control unit 32 then waits (step 54) for receipt of the appropriate control input for commanding the lowering of the bed from the first low height position. When this input has been received, the control unit 32, at step 56, activates the actuator or actuators 30 to lower the bed further until the lowest height is reached (that is height $D_2$ shown in FIG. 3). The lowest height may be sensed by an appropriate frame 16, 18 position sensor or by an actuator drain sensor, since the lowest height in the preferred embodiment preferably represents a height below which the bed 10 cannot physically go any lower.

The invention claimed is:

1. A method of controlling the height of a bed provided with one or more height control actuators, including the steps of:

a. providing a first control input which lowers the bed to a first height, the first control input being effected by the depression of a single key on a key pad; and b. providing a second control input distinct from the first control input for lowering the bed below the first height, the second control input being effected by the simultaneous depression of two or more keys of the key pad.

2. A method according to claim 1, including the step of stopping lowering of the bed when the first height is reached.

3. A method according to claim 1, wherein the first height is between around 38 to 45 centimeters from floor level.

4. A method according to claim 1, wherein the second control input is provided on a care staff key pad.

5. A method according to claim 1, wherein the second control input only takes effect when the first height has been reached.

6. A method according to claim 1, wherein the step of lowering the bed lower than the first height moves the bed at a slower rate than the rate of lowering of the bed to the first height.

7. A method according to claim 6, wherein the slower rate is one half of the rate of lowering of the bed to the first height.

8. A system for adjusting the height of a hospital bed provided with one or more height control actuators, including an input unit arranged to provide a first control input effected by the depression of a single key on a key pad bearing multiple keys, a control unit operable upon receipt of the first control input to lower the bed to a first height, the input unit being arranged to provide a second control input distinct from the first control input and effected by two or more depressions of one or more of the keys of the key pad, the control unit being operable upon receipt of the second control input to lower the bed lower than said first height, wherein such lowering of the bed lower than the first height occurs at a slower rate than the rate of lowering of the bed to the first height.

9. A system according to claim 8, where the control unit is operable to stop the lowering of the bed when the first height is reached.

10. A system according to claim 8, wherein the first height is between around 38 to 45 centimeters from floor level.

11. A system according to claim 8, including a care staff key pad for effecting the control inputs to the control unit.

12. The system of claim 8, wherein the two or more depressions of the second control input are simultaneous.

13. The system of claim 8, wherein the two or more depressions of the second control input are sequential.

14. The system of claim 8 wherein the slower rate is at least approximately one half of the rate of lowering of the bed to the first height.

15. A system for adjusting the height of a hospital bed provided with one or more height control actuators, including:

a. an input unit arranged to provide a first control input, and b. a control unit:

(1) operable to lower the bed to a first height upon receipt of the first control input, and (2) operable to lower the bed lower than the first height upon receipt of a second control input effected by a command sequence defined by simultaneous entry of two or more inputs from distinct input devices, wherein such lowering of the bed lower than the first height occurs at a slower rate than the rate of lowering of the bed to the first height.

16. The system of claim 15 wherein the control unit at least momentarily halts lowering of the bed following lowering of the bed to the first height.

17. The system of claim 15 wherein the first height is between around 38 to 45 centimeters from floor level.

18. The system of claim 15 wherein the slower rate is at least approximately one half of the rate of lowering of the bed to the first height.

19. A bed having one or more height control actuators and a key pad bearing multiple keys for providing inputs to the actuators, wherein:

a. the bed lowers to a first height once a first control input is supplied to the control, the first control input being effected by the depression of a single key on the key pad, b. the bed lowers to a second height lower than the first height only after a second control input is supplied to the control when the bed is situated at the first height, wherein the second control input is effected by two or more depressions of one or more of the keys of the key pad, and c. the bed, when lowering to the second height, moves more slowly than when lowering to the first height.

20. The bed of claim 19 wherein the bed at least momentarily halts motion after it lowers to the first height when a first control input is supplied to the control.

21. The system of claim 19, wherein the two or more depressions of the second control input are simultaneous.

22. The system of claim 19, wherein the two or more depressions of the second control input are sequential.

23. The bed of claim 19 wherein the first height is between around 38 to 45 centimeters from floor level.

24. The bed of claim 19 wherein the bed, when lowering to the second height, lowers at a rate which at least approximates half the rate at which the bed lowers to the first height.

* * * * *